US011226144B2

(12) United States Patent
Lesage et al.

(10) Patent No.: US 11,226,144 B2
(45) Date of Patent: Jan. 18, 2022

(54) R-744 SYSTEM WITH HOT GAS DEFROST BY THE TRANSCRITICAL COMPRESSORS

(71) Applicant: SYSTEMES LMP INC., Laval (CA)

(72) Inventors: Gaétan Lesage, Blainville (CA); Jordan Kantchev, Longueuil (CA)

(73) Assignee: SYSTEMES LMP INC., Laval (CA)

( * ) Notice: Subject to any disclaimer, the term of this patent is extended or adjusted under 35 U.S.C. 154(b) by 193 days.

(21) Appl. No.: 15/983,640

(22) Filed: May 18, 2018

(65) Prior Publication Data

US 2019/0353412 A1 Nov. 21, 2019

(51) Int. Cl.
*F25B 47/02* (2006.01)
*F25B 13/00* (2006.01)

(52) U.S. Cl.
CPC ..... *F25B 47/025* (2013.01); *F25B 13/00* (2013.01)

(58) Field of Classification Search
CPC ..... F25B 7/00; F25B 9/00
See application file for complete search history.

(56) References Cited

U.S. PATENT DOCUMENTS 6,807,813 B1 * 10/2004 Lesage ..... F25B 5/02 62/278
7,197,886 B2 * 4/2007 Lesage ..... F25B 29/003 62/117
2008/0229769 A1 * 9/2008 Takegami ..... F25B 13/00 62/175
2009/0260389 A1 10/2009 Dube
2014/0053583 A1 * 2/2014 Kantchev ..... F25B 6/04 62/115
2014/0352343 A1 * 12/2014 Hinde ..... F25B 1/10 62/277
2016/0010904 A1 * 1/2016 Kantchev ..... F25B 9/008 62/114
2017/0051950 A1 * 2/2017 Uselton ..... F25B 7/00

* cited by examiner

*Primary Examiner* — Gordon A Jones
(74) *Attorney, Agent, or Firm* — Praxis

(57) ABSTRACT

A transcritical R-744 refrigeration system with a medium temperature section having a plurality of circuits, at least one evaporator receiving an R-744 refrigerant in a medium-pressure liquid state from a receiver and feeding at least one transcritical compressor to compress the R-744 refrigerant from a low-pressure gaseous state into a high-pressure gaseous state to feed a gas cooler and a throttling device to partially condense the R-744 refrigerant into a medium-pressure gaseous-liquid state, the system comprising a pressure reducing valve connected to a discharge conduit of the at least one transcritical compressor and feeding hot gas to a defrost manifold to defrost one of the plurality of circuits of the medium temperature section, wherein the hot gas being fed to the defrost manifold has a pressure value less than or equal to a maximum operating pressure of the at least one evaporator.

10 Claims, 1 Drawing Sheet

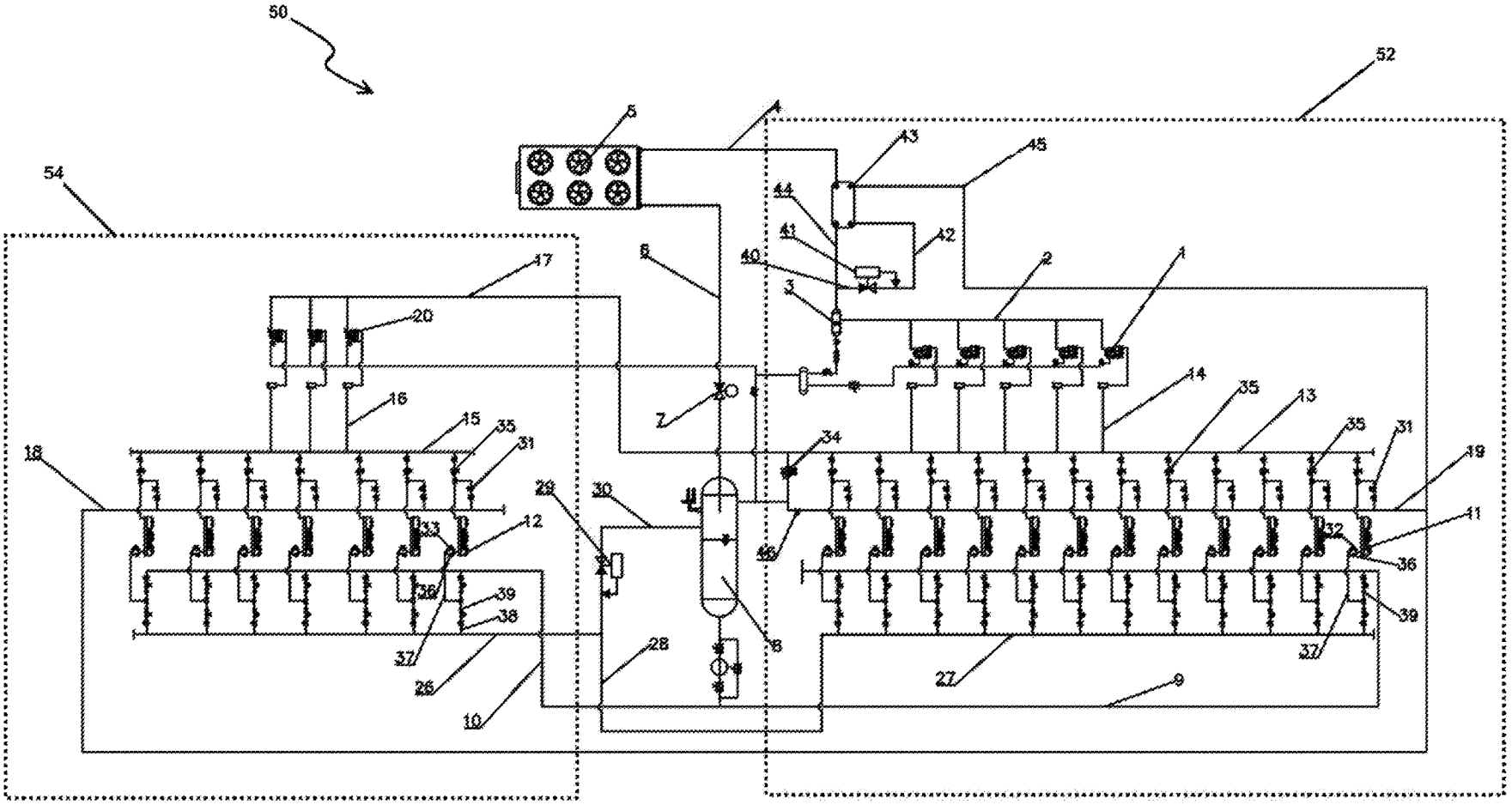
50
52
54
1
2
3
4
5
6
7
8
9
10
11
12
13
14
15
16
17
18
19
20
24
25
26
27
28
29
30
31
32
33
34
35
36
37
38
39
40
41
42
43
44
45

R-744 SYSTEM WITH HOT GAS DEFROST BY THE TRANSCRITICAL COMPRESSORS

FIELD OF THE INVENTION

The present invention relates to transcritical R-744 refrigeration systems, and more specifically to transcritical R-744 refrigeration systems with hot gas defrost by the transcritical compressors.

BACKGROUND OF THE INVENTION

In typical R-744 refrigeration systems for applications such as supermarkets and warehouses, hot gas defrost is performed by the system's subcritical (or low temperature) compressors. These compressors are used mainly because their discharge pressure is within the limits of the evaporators' allowable working pressure. However, this arrangement has several disadvantages. Firstly, during defrost periods, the discharge pressure of the low temperature compressors must be increased in order to provide a sufficient pressure differential to facilitate the return of the defrost flow being fed to the receiver (or flash tank), and to ensure that the temperature inside the evaporator during the defrost periods is above the freezing point of water. The constant demand for defrosting, especially in supermarkets, ensures that the low temperature compressors must operate continuously at this higher discharge pressure, which results in lower energy efficiency. Secondly, typically the low temperature section of transcritical R-744 systems, especially in supermarkets, represents roughly 25 to 30 percent of the compressors' total capacity, and thus the mass flow of the low temperature (or subcritical) compressors is significantly lower than the flow of the transcritical (or medium temperature) ones. As defrost efficiency is a function of the mass flow of the hot gas through the evaporator, the efficiency of larger refrigeration circuits suffers when defrosting is provided by low temperature R-744 compressors.

SUMMARY OF THE INVENTION

It is therefore a general object of the present invention to provide an improved transcritical R-744 refrigeration system and method that performs reliable and rapid hot gas defrost using only the transcritical compressors for this purpose.

In order to address the above and other drawbacks there is provided a transcritical R-744 refrigeration system with a medium temperature section having a plurality of circuits, at least one evaporator receiving an R-744 refrigerant in a medium-pressure liquid state from a receiver and feeding at least one transcritical compressor to compress the R-744 refrigerant from a low-pressure gaseous state into a high-pressure gaseous state to feed a gas cooler and a throttling device to partially condense the R-744 refrigerant into a medium-pressure gaseous-liquid state, the system comprising a pressure reducing valve connected to a discharge conduit of the at least one transcritical compressor and feeding hot gas to a defrost manifold to defrost one of the plurality of circuits of the medium temperature section, wherein the hot gas being fed to the defrost manifold has a pressure value less than or equal to a maximum operating pressure of the at least one evaporator.

In an embodiment, the transcritical R-744 refrigeration system further comprises a heat exchanger downstream of the pressure sensing valve, the heat exchanger transferring heat from the hot gas fed to the gas cooler to the gas exiting the pressure reducing valve.

In an embodiment, the receiver is a flash tank.

In an embodiment, the refrigerant exiting the at least one transcritical compressor passes through an oil separator before reaching the pressure reducing valve.

In an embodiment, the transcritical R-744 refrigeration system further comprises an additional defrost manifold in the medium temperature section.

In an embodiment, the transcritical R-744 refrigeration system further comprises a pressure regulating valve to regulate the pressure of the refrigerant before entering the receiver.

In an embodiment, the transcritical R-744 refrigeration system further comprises a plurality of check valves to prevent any hot gas from entering a liquid line.

In an embodiment, the transcritical R-744 refrigeration system further comprises a safety valve connected to the defrost manifold.

In an embodiment, the transcritical R-744 refrigeration system further comprises a low temperature section comprising an evaporator receiving an R-744 refrigerant from the receiver and feeding at least one subcritical compressor, wherein the hot gas is further fed to a defrost manifold in the low temperature section to defrost one of a plurality of circuits of the low temperature section.

In an embodiment, the transcritical R-744 refrigeration system further comprises an additional defrost manifold in the low temperature section.

There is also provided a method of defrosting one of a plurality of circuits of a transcritical R-744 refrigeration system with a medium temperature section having a plurality of circuits, at least one evaporator receiving an R-744 refrigerant in a medium-pressure liquid state from a receiver and feeding at least one transcritical compressor to compress the R-744 refrigerant from a low-pressure gaseous state into a high-pressure gaseous state to feed a gas cooler and a throttling device to partially condense the R-744 refrigerant into a medium-pressure gaseous-liquid state, the method comprising the steps of activating a pressure reducing valve connected to a discharge conduit of the at least one transcritical compressor, and feeding hot gas from the at least one transcritical compressor to a defrost manifold in the medium temperature section to defrost one of the plurality of circuits of the medium temperature section, wherein the hot gas being fed to the defrost manifold has a pressure value less than or equal to a maximum operating pressure of the at least one evaporator.

There is also provided a method of defrosting one of a plurality of circuits of a transcritical R-744 refrigeration system with a medium temperature section and a low temperature section each having a plurality of circuits, a plurality of evaporators receiving an R-744 refrigerant in a medium-pressure liquid state from a receiver and feeding at least one transcritical compressor and at least one subcritical compressor to compress the R-744 refrigerant from a low-pressure gaseous state into a high-pressure gaseous state to feed a gas cooler and a throttling device to partially condense the R-744 refrigerant into a medium-pressure gaseous-liquid state, the method comprising the steps of activating a pressure reducing valve connected to a discharge conduit of the at least one transcritical compressor, and feeding hot gas from the at least one transcritical compressor to at least one defrost manifold in at least one of the medium temperature section and the low temperature section to defrost one of the plurality of circuits, wherein the hot gas being fed to the at least one defrost manifold has a pressure value less than or equal to a maximum operating pressure of the plurality of evaporator.

An advantage of the present invention is that it is provides more efficient defrosting than previous R-744 refrigeration systems.

A further advantage of the present invention is that it is less costly than previous R-744 refrigeration systems as it requires less valves and no oil separator for the low temperature section.

A further advantage of the present invention is that it is less complicated than previous R-744 refrigeration systems and can defrost larger circuits, thus requiring less circuits overall.

A further advantage of the present invention is that, in the embodiment where the system comprises only a medium temperature section, the system requires less components as there is no need for a low temperature section.

BRIEF DESCRIPTION OF THE DRAWINGS

FIG. 1 is a schematic view of a transcritical R-744 refrigeration system having hot gas defrost provided by the transcritical R-744 compressors, in accordance with an illustrative embodiment of the present invention.

DETAILED DESCRIPTION OF THE ILLUSTRATIVE EMBODIMENTS

Referring to FIG. 1, there is shown a transcritical R-744 refrigeration system, generally referred to using the reference numeral 50, that uses the system's transcritical (or medium temperature) compressors to perform hot gas defrost, in accordance with an embodiment of the present invention. In an embodiment, system 50 comprises both a medium temperature (or transcritical) section 52 and a low temperature (or subcritical) section 54. In an alternate embodiment, system 50 comprises only a medium temperature section 52, thus negating then need for a low temperature section 54.

The refrigeration cycle begins at transcritical (or medium temperature) compressors 1, where refrigerant R-744 vapors are compressed by transcritical compressors 1 and then fed through conduit 2, oil separator 3, conduit 44, optional heat exchanger 43 (useful in applications such as large factories with low temperatures and large coils) and conduit 4 to gas cooler 5 where their temperature is reduced due to heat transfer with the ambient air. Then, the R-744 vapors, whose temperature has been reduced while pressure remains high, are fed through conduit 6 to throttling device 7 (a pressure reducing device such as a throttling/expansion/float valve, or the like), where both their pressure and temperature are reduced, thus provoking partial liquification. After the throttling device 7, the mixture of vapors and liquid are fed to the receiver 8 where separation of the vapors from the liquid occurs. The vapors from receiver 8 are fed through pressure regulating valve 34 to the suction of the transcritical (or medium temperature) compressors 1. In alternate embodiments, receiver 8 is a flash tank and pressure regulating valve 34 is a flash gas bypass valve. The resulting liquid from receiver 8 is fed to the medium temperature section 52 of the system 50 through conduit 9, expansion valves 32 and medium temperature evaporators 11. As a person of ordinary skill in the art would understand, as the liquid refrigerant passes through evaporators 11, it absorbs heat from the ambient air and changes states back to vapor, thus cooling the ambient air. Then, the R-744 vapors returns to transcritical (or medium temperature) compressors 1 to restart the refrigeration cycle.

In the embodiment where system 50 comprises a low temperature section 54, the resulting liquid from receiver 8 is also fed through conduit 10, expansion valves 33 and low temperature evaporators 12. After the evaporation process at evaporators 12 which provides refrigeration to the ambient air, low-pressure R-744 vapors are fed through suction manifold 15 and compressor suction conduit 16 to the suction port of low temperature or subcritical compressors 20. The R-744 vapors compressed by subcritical compressors 20 are fed through conduit 17 directly to the suction manifold 13 and through compressor suction conduits 14 to join the R-744 vapors from the medium temperature section 52 as they enter transcritical (or medium temperature) compressors 1 to restart the refrigeration cycle.

Still referring to FIG. 1, when defrosting is required for a given circuit in the system 50 in either the medium temperature section 52 or the low temperature section 54 (in the embodiment that comprises a low temperature section), an electronically operated pressure reducing valve 41 is activated. High temperature and high-pressure vapors are fed from transcritical compressors 1 through conduit 40 and pressure reducing valve 41, where their pressure is reduced to a level that is compatible with the certified maximum operating pressure of evaporators 11, 12 and that corresponds to a R-744 vapor condensing temperature that is higher than the freezing point of water.

As the vapors exit pressure reducing valve 41, their temperature is reduced due to throttling, which can influence the effectiveness of the defrosting process. Thus, in an alternate embodiment, to recuperate a considerable portion of this temperature loss, the vapors from pressure reducing valve 41 are fed through conduit 42 to heat exchanger 43 where the vapors are reheated by heat transfer with the rest of the hot high-pressure vapors.

Still referring to FIG. 1, the R-744 vapors from pressure reducing valve 41 (or from heat exchanger 43 in the above-mentioned alternate embodiment) are fed through conduit 45, defrost manifold 18 or 19 and valve 31 to the suction line of the circuit requiring defrosting. At this point, the electronic expansion valves 32 or 33 and the suction stop valve 35 are closed. The R-744 vapors are then fed through evaporator 11 or 12, check valve 36, conduits 37, 38, defrost manifold 26 or 27 and conduit 28 to pressure regulating valve 29, and then through conduit 30 to the receiver (flash tank) 8. Check valve 39 is used to prevent the hot gas from entering the liquid line, which is necessary due to the low pressure of the R-744 refrigerant. Valve 29 maintains the pressure in conduit 28 to be higher than the pressure in receiver (flash tank) 8 to ensure the return of the condensate from the circuit having been defrosted to the receiver 8. Valve 46 serves as a safety valve in case of a rapid surge of the defrost pressure.

Advantageously, transcritical R-744 refrigeration system 50 provides more efficient defrosting than previous R-744 refrigeration systems and is less costly as it requires less valves and no oil separator for the low temperature section 54. Further, system 50 is less complicated than previous R-744 refrigeration systems and can defrost larger circuits, thus requiring less circuits overall. Further, in an alternative embodiment, as defrosting is provided by transcritical compressors 1, system 50 only comprises a medium temperature section 52, negating the use for low temperature section 54. Further, in the embodiment where the system 50 comprises only a medium temperature section 52, the system 50 requires less components as there is no need for a low temperature section 54.

The scope of the claims should not be limited by the preferred embodiments set forth in the examples, but should be given the broadest interpretation consistent with the description as a whole.

The invention claimed is:

1. A transcritical R-744 refrigeration system (50) with a transcritical medium temperature section (52) having a plurality of circuits, at least one medium temperature evaporator (11) receiving an R-744 refrigerant in a medium-pressure liquid state from a receiver (8) and feeding at least one medium temperature compressor (1) to compress the R-744 refrigerant from a low-pressure gaseous state into a high-pressure gaseous state to feed a gas cooler (5) and a pressure reducing device (7) to partially condense the R-744 refrigerant into a medium-pressure gaseous-liquid state, the system (50) comprising:

a pressure reducing valve (41) directly connected to a discharge conduit (2) of the at least one medium temperature compressor (1) and directly feeding a portion of said R-744 refrigerant in hot gas phase to a defrost manifold (19, 18) to defrost one of the plurality of circuits of the transcritical medium temperature section (52) or one of a plurality of circuits of a subcritical low temperature section (54);

said pressure reducing valve (41) reducing a pressure of said portion of said R-744 refrigerant in hot gas phase flowing therethrough and being fed to said defrost manifold (19, 18) to a pressure value less than or equal to a maximum operating pressure of the at least one medium temperature evaporator (11) or of at least one low temperature evaporator (12) of the subcritical low temperature section (54), respectively.

2. The transcritical R-744 refrigeration system (50) of claim 1, further comprising a heat exchanger (43) downstream of said pressure reducing valve (41), said heat exchanger (43) transferring heat from the high-pressure gaseous state of said R-744 refrigerant from the at least one medium temperature compressor (1) and fed to the gas cooler (5) to the hot gas phase of said portion of said R-744 refrigerant exiting said pressure reducing valve (41).

3. The transcritical R-744 refrigeration system (50) of claim 1, wherein the receiver (8) is a flash tank.

4. The transcritical R-744 refrigeration system (50) of claim 1, wherein the refrigerant exiting the at least one medium temperature compressor (1) passes through an oil separator (3) before reaching said pressure reducing valve (41).

5. The transcritical R-744 refrigeration system (50) of claim 1, further comprising an additional defrost manifold (27) in the transcritical medium temperature section (52) between said at least one medium temperature evaporator (11) and the receiver (8).

6. The transcritical R-744 refrigeration system (50) of claim 5, further comprising a pressure regulating valve (29) to regulate the pressure of the refrigerant in said additional defrost manifold (27) before entering the receiver (8).

7. The transcritical R-744 refrigeration system (50) of claim 1, further comprising a plurality of check valves (36, 39) to prevent any hot gas phase of said portion of said R-744 refrigerant from entering a liquid line.

8. The transcritical R-744 refrigeration system (50) of claim 1, further comprising a safety valve (46) connected to said defrost manifold (19).

9. The transcritical R-744 refrigeration system (50) of claim 1, wherein said at least one low temperature evaporator (12) receiving the R-744 refrigerant from the receiver (8) and feeding at least one low temperature compressor (20).

10. The transcritical R-744 refrigeration system (50) of claim 9, further comprising an additional defrost manifold (26) in the subcritical low temperature section (54) between said at least one low temperature evaporator (12) and the receiver (8).

* * * * *